US005730690A

United States Patent [19]

Guidry

[11] Patent Number: 5,730,690

[45] Date of Patent: Mar. 24, 1998

[54] BALANCING AND LOCOMOTION BOARD

[76] Inventor: Don D. Guidry, P. O. Box 30, Cecilia, La. 70521

[21] Appl. No.: 718,767

[22] Filed: Sep. 25, 1996

Related U.S. Application Data

[62] Division of Ser. No. 589,485, Jan. 22, 1996, Pat. No. 5,584,787.

[51] Int. Cl.[6] ..... A63B 21/16

[52] U.S. Cl. ..... 482/146; 482/147; 482/34

[58] Field of Search ..... 482/34, 146, 147, 482/135, 79, 80; D21/191, 195; 280/87.042, 87.041

[56] References Cited

U.S. PATENT DOCUMENTS

| | | | |
|---|---|---|---|
| D. 193,010 | 6/1962 | Krauss | 482/147 |
| D. 223,113 | 3/1972 | King | D21/191 |
| 3,911,907 | 10/1975 | Smith, Jr. | 482/147 |
| 4,220,329 | 9/1980 | Agyagos | 482/147 |
| 4,530,498 | 7/1985 | Heatwole | 482/146 |
| 5,292,296 | 3/1994 | Davignon | 482/146 |
| 5,547,447 | 8/1996 | Liang | 482/147 |
| 5,603,334 | 2/1997 | Sharp | 482/146 |

FOREIGN PATENT DOCUMENTS

| | | | |
|---|---|---|---|
| 1724280 | 4/1992 | U.S.S.R. | 482/146 |
| 1112697 | 5/1968 | United Kingdom | 482/147 |

*Primary Examiner*—Jerome Donnelly
*Attorney, Agent, or Firm*—Robert N. Montgomery

[57] ABSTRACT

A balancing apparatus emulating the acrobatics associated with skate boards etc. having a elongated platform, one or more hemispherical, pivotal fulcrums, rotational with respect to a elongated platform, and a foot plate, attached to the fulcrum member. A single fulcrum may be used in conjunction with a truncated, conical, stationary member for encouraging parallel orientation of the platform. A detachable, restricting ring is also provided for reducing the angulation of the platform with the supporting surface during use. The user stands on one foot plate and attempts to maintain balance on the fulcrum member while manipulating the platform with the other foot, at the opposite end of the apparatus, which may also contain a fulcrum member or a stationary truncated, conical member.

7 Claims, 3 Drawing Sheets

BALANCING AND LOCOMOTION BOARD

This is a division of application Ser. No. 08/589,485 filed Jan. 22, 1996, U.S. Pat. No 5,584,787 now allowed.

BACKGROUND OF THE INVENTION

FIELD OF THE INVENTION

This invention relates to balancing and teeter boards in general, used for improving an individuals balance or as an exercise apparatus. And more particularly to locomotion accomplished by having both rocking and pivotal means.

GENERAL BACKGROUND

This invention relates to rocking, locomotion devices upon which a persons stands, whereby locomotion can be achieved by a series of combined rocking and pivoting movements emulating snow boarding or skate boarding.

In the field of locomotion devices, there exists a group commonly known as "wobble boards" which are so constructed that they may be moved over the surface of a floor by the pivoting and rocking movements of a person standing on the board.

These wobble boards all have the same operating principle embodied by the lateral altering of a central point of support, that the wobble board makes with the floor, by rocking the board from side to side while pivotally moving the board at the ends of the rocking movements so as to move across the floor.

The operation of these wobble boards is quite simple and requires only a limited sense of balance. Even the more sophisticated apparatus disclosed by "Stolle" in U.S. Pat. No. 3,419,267 fails to emulate the maneuvers and acrobatics often associated with skate and snow boarding.

Various types of teeter boards have also been used for exercise and as a training regimen for enhancing one's balance capability. As a rule most such apparatus are not meant for locomotion. However, U.S. Pat. Nos. 3,024,021 and 4,491,318 disclose wobble boards having hemispherical pivot members. In which case they could be urged through a series of rocking movements to move across the floor. In both cases the pivot members are associated with a circular board, unlike that of boards normally related to teeter boards which usually have a roller centrally located below a elongated board. Both of these disclosures rely on a single pivotal element and only "Francke" U.S. Pat. No. 4,491,318 suggests that such a pivotal element could be offset from the center of the circular disk. Neither of these patents suggest the use of dual and/or rotating pivoting members with respect to the platform, whereby the user could emulate the heal and toe longitudinal manipulation of a elongated board normally associated with skate or snow boards.

SUMMARY OF THE PRESENT INVENTION

The present invention is a balance board which is particularly adapted to train individuals for more complex balancing apparatus, by enhancing their balancing and manipulation capabilities in a controlled environment. The present balancing apparatus is designed to allow the individual to enhance his balancing skill and to pivot and walk the board by doing end to end rotations very much like the acrobatics used in skate boarding. Two embodiments of the balance board are offered, one having a fulcrum in the form of a rotatable, hemispherical member located near one end of the elongated board and a fixed, non-rotatable, truncated, conical member located near the opposite end. These members are located on the longitudinal center line of the platform, with about two thirds of the platforms length between them. In this embodiment the user can stabilize the board with the truncated conical member, which also serves as a pivot point, while learning to maintain balance with the rotatable, hemispherical, pivotal member. By manipulating the hemispherical member with one foot, the stationary, truncated conical pivot is lifted clear of the floor allowing the board to be rotated as a result of the user twisting his/her body. To stabilize both pivotal and rotary movements, the user need only press down on the stationary truncated conical pivot member. Alternatively, placing one's weight over the stationary, truncated conical, pivot, the elongated platform can be rotated by twisting the users body but in a more stable manner as a result of the truncated conical member's truncation.

A second embodiment used by the more advanced user allows for full, 360 degree turns, board balancing, and walking routines. This embodiment utilizes two hemispherical members as pivots located near each end of the elongated platform thus requiring a greater sense of balance to maintain control as a result of both ends of the board being rotational and pivotal. In either case the hemispherical members may be fitted with tilt limiting rings thus restricting the angle of tilt in order to conform to the ability of the user. It should be noted that a truncated, conical member could be substituted for one of the two hemispherical members used in the second embodiment in order to regain some degree of control. The second embodiment having two hemispherical members is considerably larger than that of the single hemispherical member type and is usually used by older and larger users.

BRIEF DESCRIPTION OF THE DRAWINGS

The above mentioned features, as well as other aspects and advantages, will become evident in the detailed description in reference to the included drawings. In the drawings.

DETAILED DESCRIPTION OF THE PREFERRED EMBODIMENT

Figure 1:
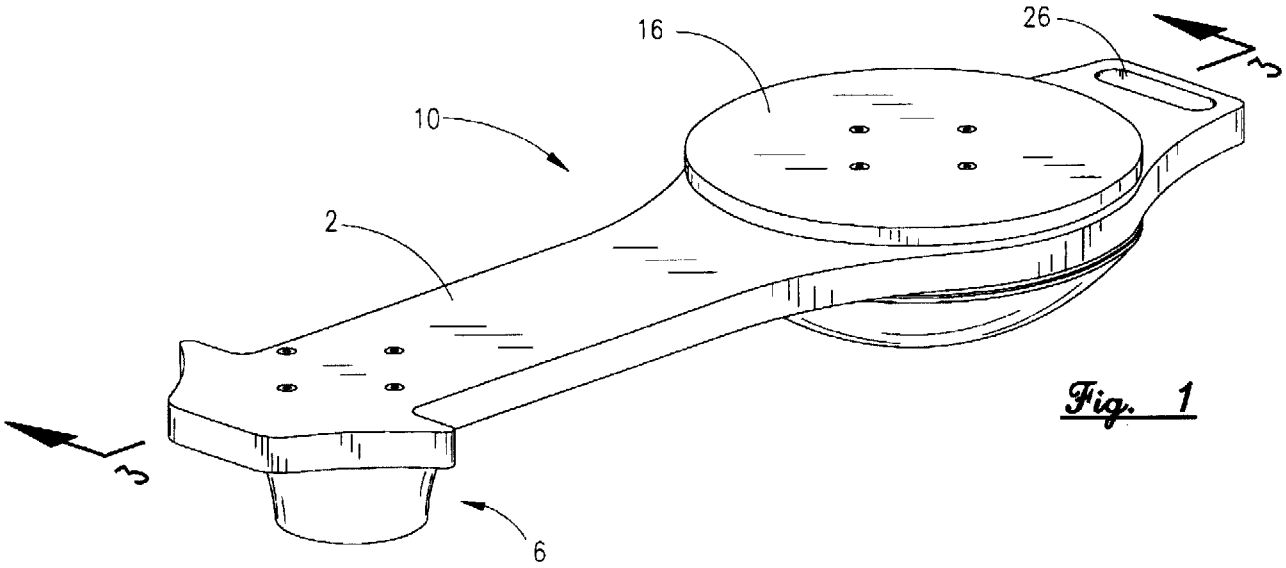
FIG. 1 is a perspective view of the invention illustrating a balance board apparatus having a single, rotatable, hemispherical, pivot member and a stationary, truncated conical member.

The single-pivot balancing board 10 of the present invention as illustrated in FIG. 1 comprises an elongated platform 2 constructed of any suitable, rigid material such as wood, metal, plastic or a composite having high impact and flexural strength. The board or platform 2 may be of any desired, elongated configuration.

Figure 3:
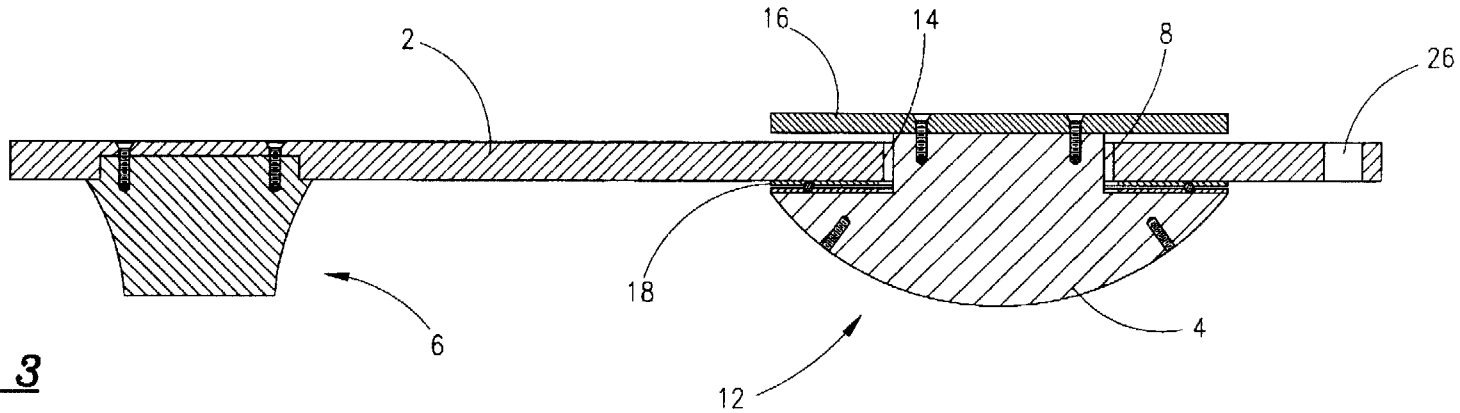
FIG. 3 is a cross section view of the balance board apparatus taken along the longitudinal center line of FIG. 1.
Figure 4:
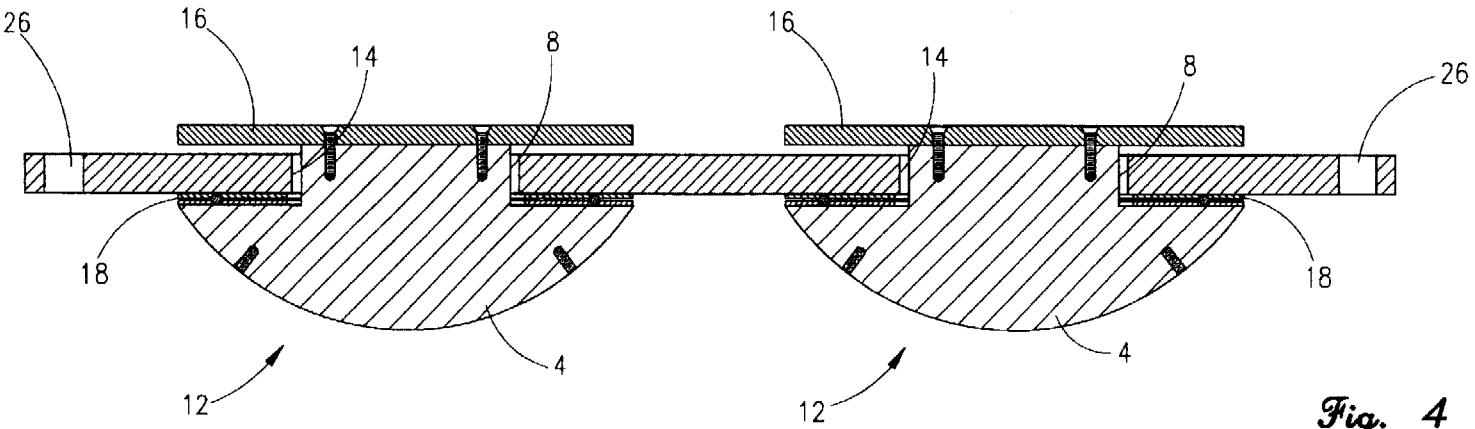
FIG. 4 is a frontal elevation, cross section view of the balance board apparatus taken along the longitudinal center line of FIG. 2.

At least one hemispherical pivot 12 is rotatable attached to one face of the platform 2 near one end. A second hemispherical pivot 12 may be rotatable mounted near the opposite end of the platform 2 as illustrated in FIG. 4, or a truncated, conical, stationary member 6 as seen in FIG. 3 may be substituted. Having two, rotatable, hemispherical pivots 12 greatly increases the difficulty of controlling the balancing board 10 but allows for much greater freedom of movement and acrobatic maneuvers.

It is important to note that the hemispherical pivot 12 is a partial sphere having a cylindrical or shank portion 8 somewhat smaller in diameter than that of the spherical portion 4. When attaching the hemispherical pivot 12 to the board or platform 2, the cylindrical shank portion 8, of hemispherical pivot 12, is inserted through a diametrical opening 14 in the platform 2, extending slightly beyond the platform. The hole 8 is located on the longitudinal centerline of the elongated platform 2 near one or both ends. The diametrical holes 8 for receiving the cylindrical portion of the hemispherical pivots are spaced at approximately two-thirds of the platform's length, thus the remaining third is divided at each end. A circular foot plate 16 is then attached perpendicularly to the end of the cylindrical portion 8 of the hemispherical pivot 12 with screws 15 thus allowing the platform 2 to be rotatable about the central axis of the hemispherical pivot 12. The hemispherical pivots 12 allow for non-parallel orientation of the board or platform 2 with the support surface in some cases while the truncated conical pivot 6 encourages parallel orientation with the support surface.

Figure 2:
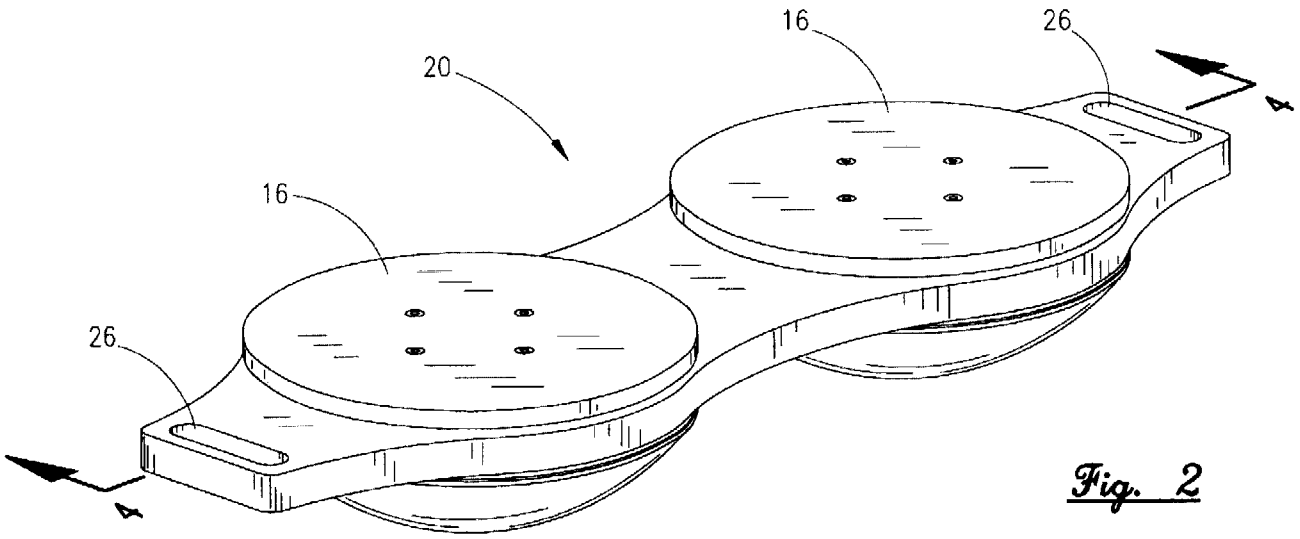
FIG. 2 is a perspective view of the invention illustrating a balance board having two rotatable, hemispherical, pivot members.
Figure 5:
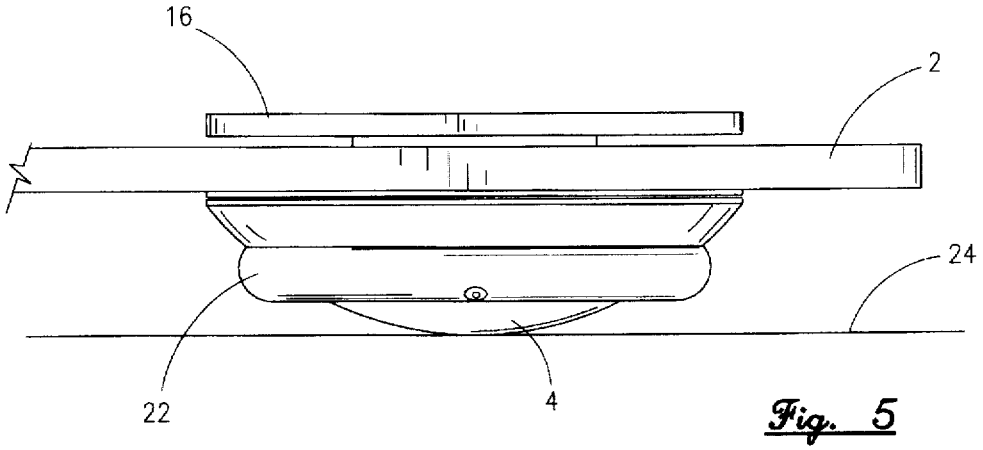
FIG. 5 is a fragmentary, frontal elevation view of the balance board and rotatable, hemispherical, pivot member shown with a restricting or limiting ring.
Figure 6:
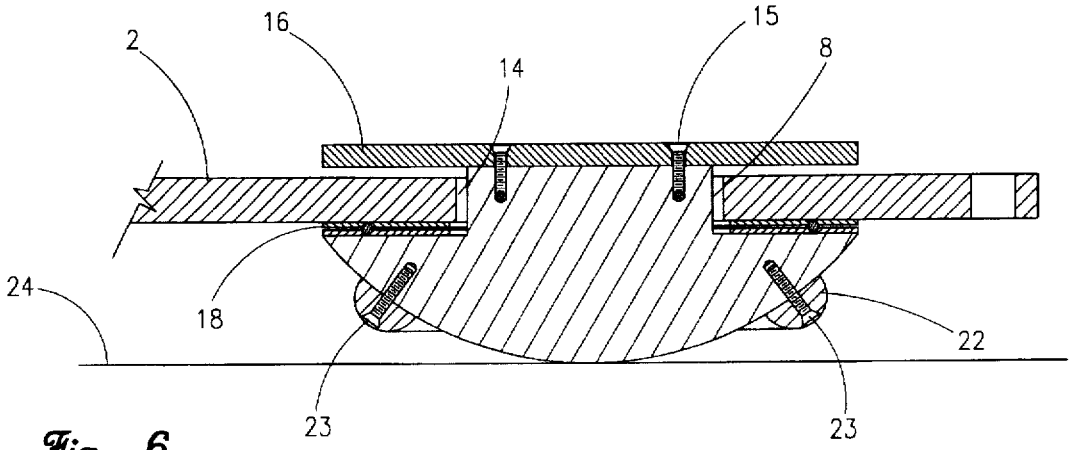
FIG. 6 is a vertical, cross section view of the balance board and rotatable, hemispherical, pivot member taken along the longitudinal center line of FIG. 5.

A greater freedom of rotation of the board or platform 2 may be insured with the use of a bearing 18 located between the hemispherical pivot 12 and the platform 2. However, in some cases a bearing may not be necessary due to the use of phenolic and polyethylene type materials. In the preferred embodiment, the bearing arrangement 18 is a large platform bearing 18 having an upper and lower plate with a row of ball bearings running in a groove between the plates. The upper plate of the bearing 18 is attached to the platform 2 and its lower plate is attached to the hemispherical pivot 12. It is anticipated that alternative bearing arrangements could be used whereby a thrust bearing is located between the foot plate 16 and the platform 2 and another located between the platform 2 and the hemispherical pivot 12. Elongated slots 26 may be provided at one or both ends of the platform 2 serving as a handle allowing the user to pick up and carry the balance boards 10, 20 or assist in its manipulation during acrobatic maneuvers. Initial training starts with a balance board 10 fitted with one rotatable, hemispherical pivot 12 and one stationary, truncated conical member 6 thus allowing the user to learn both balance and rotation while maintaining some degree of stability. The stationary member 6 restricts rotation and stabilizes tilting of the hemispherical pivot 12 when the user's body weight is shifted. As the user advances in skill, the conical, stationary member 6 type board, illustrated in FIGS. 1 & 3, may be replaced by either the more advanced dual pivot type balancing board 20, illustrated in FIGS. 2 & 4 or a board outfitted for dual, hemispherical pivots 12 but having been fitted with a stationary, truncated conical member 6 which can be removed and replaced with a second, rotatable, hemispherical pivot 12. In either case a demountable limiting ring 22 as seen in FIGS. 5 & 6, normally attached to the hemispherical pivot 12, may also be removed by simply removing screws 23. This ring 22 is attached circumferentially to the hemispherical pivot 12 at a point approximately halfway between the hemispherical portion's 4 contact with the bearing 18 or platform 2 and the floor or support surface 24, limiting angular pivotal movement of the hemispherical pivot 12.

While there has been herein shown and described the presently preferred form of the present invention, it is to be understood that such has been done for the purpose of illustration only, and that various changes may be made therein within the scope of the appended claims.

What is claimed is:

1. A balancing apparatus comprising:

a) an, elongated rigid platform, having a first and second end, said platform further having diametrical openings at said first and second ends;

b) a pair of hemispherical pivoting means having cylindrical shank portions, extending through said diametrical openings said shank portion having a free end passing from a bottom side of said platform to a top side of said platform, said cylindrical shank being rotatable relative to said platform, for allowing said platform to pivot on a support surface; and c) a disk, adapted to support at least one foot of a user thereon being perpendicularly attached to each of said cylinder shank portions of said hemispherical pivoting means at said free end.

2. A balancing apparatus according to claim 1 wherein said hemispherical pivot means further comprises a bearing means, for holding said hemispherical pivoting means in a spaced apart, rotational relationship with said, elongated rigid platform.

3. A balancing apparatus according to claim 1 wherein said cylindrical shank portions extend above said elongated, rigid platform in a manner whereby said disk is held spacedly apart from said elongated, rigid platform.

4. A balancing apparatus according to claim 3 wherein said elongated, rigid platform has at least one elongated slot for use as a handle.

5. A balancing apparatus according to claim 4 wherein said hemispherical pivoting means further comprises a demountable limiting means, attached thereto, for restricting pivotal orientation of said elongated rigid platform relative said supporting surface.

6. A method of acrobatic balancing comprising the steps of:

a) Providing a balancing apparatus comprising:

i) an, elongated rigid platform, having a first and second ends, said platform further having diametrical openings at said first and second ends;

ii) a pair of hemispherical pivoting means having cylindrical shank portions, extending through said diametrical openings said shank portion having a free end passing from a bottom side of said platform to a top side of said platform, said cylindrical shank being rotatable relative to said platform, for allowing said platform to pivot on a support surface; and iii) a disk, adapted to support at least one foot of a user thereon being perpendicularly attached to each of said cylinder shank portions of said hemispherical pivoting means at said free end;

b) placing at least one foot on at least one of said disk; and c) manipulating said elongated platform with one foot while maintaining balance on said hemispherical pivot means.

7. A method of acrobatic balancing according to claim 6 wherein a limiting means is provided for limiting pivotal orientation of said elongated rigid platform relative said supporting surface.

* * * * *